US007264845B2

(12) United States Patent
Papadaki et al.

(10) Patent No.: US 7,264,845 B2
(45) Date of Patent: Sep. 4, 2007

(54) METHOD FOR INCREASING THE HYDROPHOBICITY OF A LAVATORY BOWL SURFACE

(75) Inventors: Maria Papadaki, Kraaincrn (BE); Vincenzo Tomarchio, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/834,558

(22) Filed: Apr. 29, 2004

(65) Prior Publication Data

US 2004/0216227 A1 Nov. 4, 2004

(30) Foreign Application Priority Data

Apr. 29, 2003 (EP) ..... 03447099

(51) Int. Cl.

| | |
|---|---|
| ***B05D 7/22*** | (2006.01) |
| ***B05D 1/26*** | (2006.01) |
| ***B05D 1/36*** | (2006.01) |
| *E03D 9/02* | (2006.01) |

(52) U.S. Cl. ..... 427/230; 427/407.1

(58) Field of Classification Search ..... 427/230, 427/402, 407.1; 4/300, 309, 311, 420, 222, 4/223, 224, 229, 230, 231, 232

See application file for complete search history.

(56) References Cited

U.S. PATENT DOCUMENTS

| | | | | |
|---|---|---|---|---|
| 3,812,044 | A | | 5/1974 | Connor et al. |
| 4,704,233 | A | | 11/1987 | Hartman et al. |
| 5,336,427 | A | | 8/1994 | Bunczk et al. |
| 5,460,747 | A | * | 10/1995 | Gosselink et al. ..... 510/220 |
| 6,169,066 | B1 | | 1/2001 | Gasmena |
| 6,230,334 | B1 | | 5/2001 | Camp et al. |

FOREIGN PATENT DOCUMENTS

| | | | | |
|---|---|---|---|---|
| EP | 0 538 957 | A1 | * | 4/1993 |
| EP | 0 775 741 | A1 | | 5/1997 |
| EP | 1 046 756 | A1 | | 10/2000 |
| EP | 1 245 666 | A1 | | 10/2002 |
| EP | 1 245 667 | A1 | | 10/2002 |
| EP | 1 245 666 | A1 | * | 10/2005 |
| GB | 2345494 | A | | 7/2000 |
| GB | 2358028 | A | | 7/2001 |
| WO | WO 96/38637 | A1 | | 12/1996 |
| WO | WO 97/36967 | A1 | * | 10/1997 |
| WO | WO 98/17765 | A1 | | 4/1998 |
| WO | WO 99/15375 | A1 | | 4/1999 |
| WO | WO 99/66140 | A1 | | 12/1999 |
| WO | WO 00/42261 | A1 | | 7/2000 |
| WO | WO 00/49238 | A1 | | 8/2000 |
| WO | WO 01/02653 | A1 | | 1/2001 |
| WO | WO 01/06067 | A2 | | 1/2001 |
| WO | WO 01/44591 | A1 | | 6/2001 |
| WO | WO 01/77451 | A1 | | 10/2001 |
| WO | WO 01/94520 | A2 | | 12/2001 |
| WO | WO 02/04951 | A1 | | 1/2002 |
| WO | WO 02/40792 | A1 | | 5/2002 |

OTHER PUBLICATIONS

U.S. Appl. No. 10/834,559, filed Apr. 29, 2004, Papadaki et al.

* cited by examiner

*Primary Examiner*—William Phillip Fletcher, III
(74) *Attorney, Agent, or Firm*—David V. Upite; Mark A. Charles; Amy I. Ahn-Roll

(57) ABSTRACT

The present invention encompasses a method for increasing the hydrophobicity of at least parts of a lavatory bowl surface comprising the steps of repeatedly applying to at least parts of said lavatory bowl surface a solution comprising less than 30 ppm of a surface modifying polymer.

20 Claims, 1 Drawing Sheet

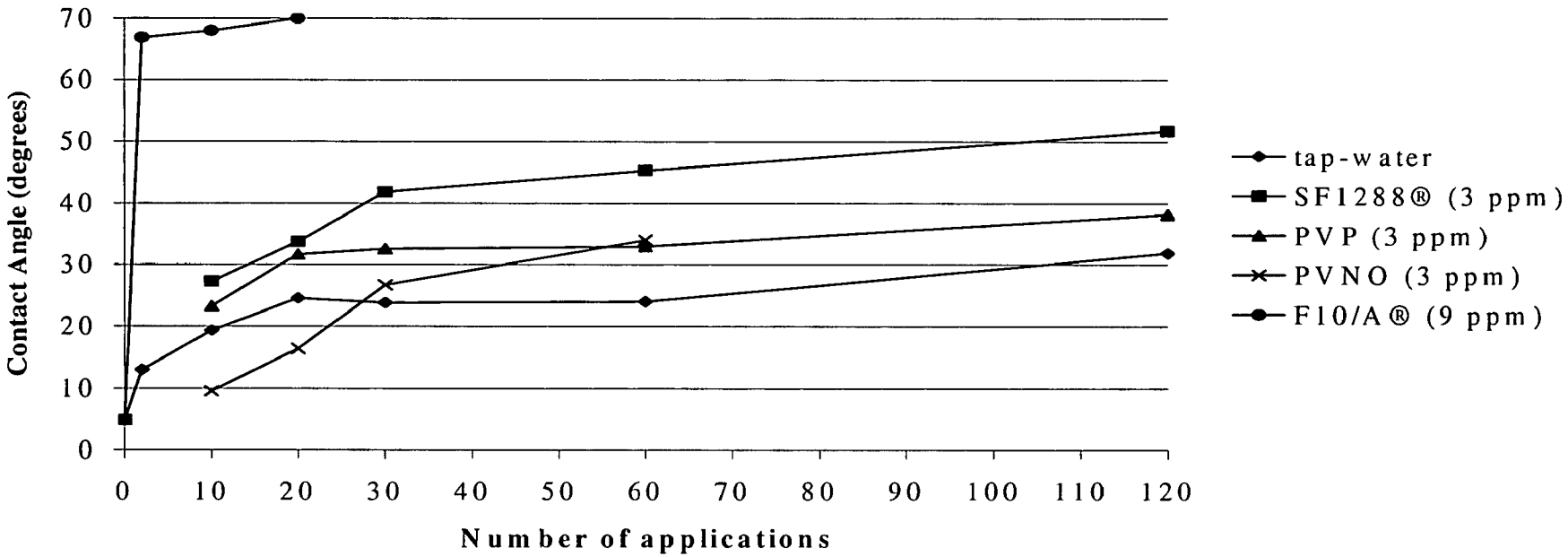
tap-water
SF1288® (3 ppm)
PVP (3 ppm)
PVNO (3 ppm)
F10/A® (9 ppm)
Contact Angle (degrees)
0
10
20
30
40
50
60
70
Number of applications
0
10
20
30
40
50
60
70
80
90
100
110
120

METHOD FOR INCREASING THE HYDROPHOBICITY OF A LAVATORY BOWL SURFACE

CROSS REFERENCE TO RELATED APPLICATIONS

This application claims the benefit of the filing date of EPO application serial no. 0344099.7 filed Apr. 29, 2003.

TECHNICAL FIELD

The present invention relates to a method for increasing the hydrophobicity of at least parts of a lavatory bowl surface comprising the steps of repeatedly applying to at least parts of said lavatory bowl surface a solution comprising less than 30 ppm of a surface modifying polymer.

BACKGROUND

A great variety of ways to treat, particularly clean, lavatory bowls, such as toilet bowls, have been described in the art. One particular way of treating lavatory bowls, such as toilet bowls, are so called rim-blocks. Indeed, rim-blocks are devices that dispense liquid or solid compositions directly into the flush water of a lavatory bowl from under the rim of said bowl. Such rim-blocks are usually attached by various means, such as hooks and the like, to the rim of the lavatory bowl. Every time a toilet equipped with a rim-block is flushed, an amount of composition is dispensed into the lavatory bowl and in turn acts in solution on the lavatory bowl surface. Due to the relatively large amounts of water used to flush lavatory bowls, the end-concentration of actives of said composition is relatively low. This is compensated by the fact that the composition is applied onto the lavatory bowl surface with every flush of the lavatory bowl. Liquid and solid rim-blocks are already known in the art.

The present invention in its most preferred embodiment relates to the repeated application to at least parts of a lavatory bowl surface a solution using a so-called liquid rim-block comprising at least one liquid composition.

Examples of liquid rim-blocks known in the art include a liquid rim-block device having a suspension means and at least two compartments for active substances (WO 02/40792), or a lavatory cleaning system comprising a dispenser for dispensing a liquid composition from under the rim of a lavatory bowl, wherein the composition has a viscosity of greater than 2500 mPa.s (WO 02/04951). Other similar systems are described in EP-A-775741 or WO 01/94520.

Even though, the currently known methods of treating a lavatory bowl according to the above cited art provide a good performance with regard to cleaning performance, it has been found by consumer research that the shine performance of the existing lavatory cleaning systems can be further improved.

Indeed, consumers are looking for a way to keep a lavatory bowl, in particular a toilet bowl, shiny over a significant number of rinse-dry cycles (i.e., toilet flushes). Indeed, mineral encrustation, such as limescale deposits, is formed on the lavatory bowl surface after each flush. In addition, dirt can be trapped in these encrustations. The encrustations and the dirt entrapped therein reduce the shine of the lavatory bowl over time.

It is therefore an objective of the present invention to provide a method of treating a lavatory bowl, wherein said method provides excellent shine performance to at least parts of the lavatory bowl surface treated.

It has now been found that the above objective can be met by a method for increasing the hydrophobicity of at least parts of a lavatory bowl surface according to the present invention.

An advantage of the present invention is that the methods as described herein have the ability to provide long lasting shine to at least parts of a lavatory bowl surface.

SUMMARY OF THE INVENTION

The present invention encompasses a method for increasing the hydrophobicity of at least parts of a lavatory bowl surface comprising the steps of repeatedly applying to at least parts of said lavatory bowl surface a solution comprising less than 30 ppm of a surface modifying polymer, to provide a contact angle between water and at least parts of said surface after at least 10 applications and up to 120 applications that is at least 5° higher as compared to the contact angle of said surface treated with water alone and does not exceed a contact angle of 55°.

BRIEF DESCRIPTION OF THE DRAWINGS

FIG. 1 is a plot showing the contact angles of different polymers applied repeatedly on ceramic tiles at diluted levels (3 ppm) and tap-water on black glossy tiles over 120 applications.

DETAILED DESCRIPTION OF THE INVENTION

Surfaces to be Treated

The method according to the present invention is used to treat the surface or at least parts thereof of a lavatory bowl, such as a toilet bowl, urinals and the like. Preferably, the method according to the present invention is used to treat the surface or at least parts thereof of the inside portion of a lavatory bowl, such as a toilet bowl, urinals and the like. More preferably, the method according to the present invention is used to treat at least parts of the inside portion of a toilet bowl or a urinal, preferably a toilet bowl.

The method as described herein may be used to treat lavatory bowl surfaces made of different materials like ceramic, enamel, vinyl, no-wax vinyl, linoleum, melamine, glass, Inox®, Formica®, any plastics, plastified wood, metal or any painted or varnished or sealed surface and the like.

Method for Increasing the Hydrophobicity of at Least Parts of a Lavatory Bowl Surface The present invention relates to a method for increasing the hydrophobicity of at least parts of a lavatory bowl surface comprising the steps of repeatedly applying to at least parts of said lavatory bowl surface a solution comprising less than 30 ppm of a surface modifying polymer, to provide a contact angle between water and at least parts of said surface after at least 10 applications and up to 120 applications that is at least 5° higher as compared to the contact angle of said surface treated with water alone and does not exceed a contact angle of 55°.

During the method of the present invention, a solution is repeatedly applied onto at least parts of a lavatory bowl surface. Said solution is formed by a composition comprising a surface modifying polymer and the water used to flush said lavatory bowl surface.

Due to inherent limitations in the distribution of flush water over a lavatory bowl surface upon flushing of said lavatory bowl, the application of the solution herein onto the lavatory bowl surface is not complete. Indeed, the solution is likely to be applied only to parts of said lavatory bowl surface.

Surface Properties

The method according to the present invention is suitable to modify the surface properties of a lavatory bowl surface.

The lavatory bowl surfaces before being treated according to the method herein are initially more or less hydrophilic or hydrophobic. The hydrophilic/hydrophobic surfaces properties of a given lavatory bowl surface, this means before and/or after the application (treating) of a solution comprising less than 30 ppm of a surface modifying polymer, can be assessed by measuring the contact angle of a solvent and said lavatory bowl surface. The general principles of hydrophilic/hydrophobic interaction between surfaces and the relation between contact angles and hydrophilic/hydrophobic surface properties can be found in "Interfacial phenomena: Equilibrium and dynamic effects" by C. Miller and P. Neogi, pages 54-90, M. Deker Inc. 1987.

As outlined above, the hydrophilic/hydrophobic properties of a given lavatory bowl surface are assessed by measuring the contact angle between a solvent and said surface. In the present invention, the solvent used to assess the hydrophilic/hydrophobic properties of a given surface is regular tap water. Contact angle measurements are done using, for example, a Dataphysics® Optical contact Angle ("OCA") instrument (OCA 20®). The OCA measures the contact angle θ of the solvent, such as water, on a surface. In the case where water is used as solvent, the higher said contact angle is, the more hydrophobic the surface is.

All contact angle measurements as outlined herein below are preformed using the following test methods:

The static contact angles of standard black glossy (SENIO®) or white porcelain tiles (VALM®) with respect to water are measured by the sessile drop method using the OCA 20® instrument wherein the tile is placed in a horizontal position, facing upward, in front of a light source. A motor-driven dosing unit delivers 10 μl of water at a given time on the tested surface. An image of the shape of the drop on the surface is taken with a CCD (digital) camera. Then from this image the static contact angle is calculated according to the sessile drop method using the SCA (software for contact angle measurements) software.

The standard black glossy (SENIO®) or white porcelain tiles (VALM®) are used to avoid measurements in the lavatory bowl itself. Indeed, the test equipment used for the measurements is less suitable for such direct tests. Furthermore, the tiles used herein have similar surface properties in terms of hydrophilic/hydrophobic properties as the lavatory bowl surfaces herein.

The resulting contact angle, which is provided to a tile by a given solution, is assessed by rinsing said tile for 15 sec with the given solution containing, e.g., 3 ppm of a surface modifying polymer in tap-water. Subsequently the tile is left to dry and subsequently the rinse/dry cycle is repeated for at least 10 times and up to 120 times. After the tile has been rinsed and dried for a specific number of times, the static contact angle is measured as described above.

The lavatory bowl surfaces herein initially, this means prior to the application of the solution herein, preferably are "substantially hydrophilic surfaces". By "substantially hydrophilic surfaces" it is meant herein that the surfaces have a contact angle of below 20°, preferably from 0° to 40°, more preferably from 1° to 16°.

Surface Properties Modification

The method herein increases the hydrophobicity of at least parts of a lavatory bowl by providing a contact angle between (tap-)water and at least parts of a lavatory bowl surface after at least 10 applications and up to 120 applications that is at least 5° higher as compared to the contact angle of said surface treated with (regular tap-)water alone and does not exceed a contact angle of 55°.

It is submitted that the contact angle measurements herein are preferably performed using tap water, as described herein above. Furthermore, the method according to the present invention preferably provides a contact angle between water and at least parts of a lavatory bowl surface that is at least 5° higher as compared the contact angle of said surface treated with regular tap-water alone. Tap-water is used as a reference herein. Indeed, tap-water is commonly used to flush lavatory bowl. Furthermore, the repeated application of deionized water onto a lavatory bowl surface will not significantly change the surface properties of said lavatory bowl surface. By "tap-water" or "regular tap-water" it is meant herein, water having an average water hardness of 60-1000 ppm of $CaCO_3$ equivalents.

The contact angle between water and at least parts of a lavatory bowl surface that is at least 5° higher, preferably from 5° to 18° higher, more preferably from 7° to 15° higher, most preferably 7° to 12° higher as compared the contact angle of said surface treated with water alone.

Furthermore, the contact angle between water and at least parts of a lavatory bowl surface does not exceed a contact angle of 55°, preferably 52°, more preferably 50°.

The method herein increases the hydrophobicity of at least parts of a lavatory bowl after at least 10 applications and up to 120 applications. Indeed, due to the very low concentration of surface modifying polymer applied onto the lavatory bowl surface herein, the increase of hydrophobicity requires at least 10 repeated applications of the solution herein onto the lavatory bowl surface to reach the a contact angle between water and at least parts of a lavatory bowl surface that is at least 5° higher as compared the contact angle of said surface treated with water alone ("hydrophobicity build up").

Preferably, the surface modification is effective over a prolonged period of time. By "a prolonged period of time" it is meant herein up to 120 applications of solution as described herein.

By "applications" it is meant herein, the flushing/rinsing of the lavatory bowl surface herein with water, more preferably regular tap-water, and the drying of said surface after the flushing/rinsing step, this is also referred to herein as a "rinse-dry cycle". During the applications/rinse-dry cycles the lavatory bowl surface herein substantially dries, this means that said liquid is substantially completely removed from the lavatory bowl surface, by e.g., running off said surface (e.g., for inclined surfaces) or evaporating (e.g., for inclined or horizontal surfaces) from said lavatory bowl surface. However, it may occur under given circumstances that a further rinsing step is performed prior to the complete drying of the lavatory bowl surface. This does not alter the performance of the present invention. Generally the lavatory bowl surfaces herein are flushed/rinsed using 6 lt. of tap-water.

The contact angle of a surface after application of a solution comprising less than 30 ppm of a surface modifying polymer and a given amount of applications can be assessed using the following test method: The static contact angles of black glossy tiles with respect to water, treated or not treated with a solution and exposed to up to 120 applications, are measured by the sessile drop method as outlined above.

A known problem with the currently available lavatory bowl cleaning systems is their limited ability to keep lavatory bowls shiny ("shine benefit") over a significant number of applications (i.e., toilet flushes). Indeed, mineral encrustation, such as limescale deposits, is formed on the lavatory bowl surface after each flush. In addition, dirt can be trapped in these encrustations. The encrustations and the dirt entrapped therein reduce the shine of the lavatory bowls over time. The liquid composition(s) herein provides a mineral encrustation prevention benefit and shine/gloss by reducing or even preventing mineral deposition on the lavatory bowl surface.

It has now been found that by increasing the hydrophobicity of at least parts of a lavatory bowl as described herein, said lavatory bowl surface is rendered less prone to the adherence and/or the build-up of limescale and mineral encrustation, etc. ("mineral deposition"). Even more so, the mineral deposition is significantly reduced or even prevented over a prolonged period of time. Indeed, lavatory bowl surfaces are subject to a high number of rinse and dry cycles in-between cleaning operations. For example, in a four-person household, a toilet is flushed approximately 120 times a week, which results in 120 rinse-dry cycles. During each rinse-dry cycle limescale and/or mineral encrustation deposition, due to the use of more or less hard water, on the rinsed surface may occur. This leads to a significant limescale and/or mineral encrustation build-up on the surfaces going through these rinse-dry cycles.

The Applicant has found that the repeated application of solution comprising less than 30 ppm of a surface modifying polymer as described herein onto a lavatory bowl surface, significantly reduces or even prevents the formation mineral deposition on said lavatory bowl surface. Without being bound by theory, it is believed that this reduction or even prevention of the formation mineral deposition on said lavatory bowl surface is due to the increased hydrophobicity after the repeated application of a solution comprising less than 30 ppm of a surface modifying polymer. Indeed, it has been found, that the surface modifying polymer, especially the silicone polymers as described herein below, deposits onto the surfaces cleaned with a composition herein and thereby increases the surface's hydrophobicity. By reducing or even preventing the formation mineral deposition on said lavatory bowl surface the encrustation of said minerals as well as the entrapment of dirt therein is reduced or even prevented, thereby the original shine of said lavatory bowl surface is protected. Indeed, the lavatory bowl surface remains shiny over a prolonged period of time, this means over a significant number of rinse-dry cycles (i.e., toilet flushes).

The shine benefit as described herein of a given solution can be determined by measuring gloss on black glossy tiles (SENIO®) and using either untreated (new) black glossy tiles or black glossy tiles treated with tab-water as a reference. Indeed, 20 cm×20 cm black glossy tiles are rinsed for 15 sec with a solution containing 3 ppm of a surface modifying polymer in tap-water. Subsequently these tiles are left to dry and subsequently the rinse/dry cycle is repeated for at least 10 times and up to 120 times. Thereafter, gloss is measured by the Tri MicroGloss 20-60-86 Instrument® (Sheen Instruments) by taking 10 measurements of each tile. The reference tiles are treated normal tab-water only for 15 sec. every time and undergo the same amount of rinse/dry cycles. The gloss of the reference tiles (either treated with water or the new tiles) is measured by the Tri MicroGloss 20-60-86 Instrument® (Sheen Instruments) by taking 10 measurements of each tile.

Solution Comprising Less Than 30 ppm of a Surface Modifying Polymer

During the method of the present invention, a solution comprising less than 30 ppm of a surface modifying polymer is repeatedly applied onto at least parts of a lavatory bowl surface. Said solution may be formed by a composition comprising a surface modifying polymer and the water used to flush said lavatory bowl surface. Indeed, every time a lavatory bowl surface herein is flushed, an amount of composition is dispensed into the lavatory bowl and in turn acts in solution on the lavatory bowl surface. Due to the relatively large amounts of water used to flush lavatory bowls, the end-concentration of actives, in particular of the surface modifying polymer in said solution is relatively low.

The solution repeatedly applied onto the lavatory bowl surface during the method herein preferably comprises from 0.1 ppm to 25 ppm, preferably from 1 ppm to 15 ppm, most preferably from 1 ppm to 5 ppm, by weight of the total solution of said surface modifying polymer.

As specified above the solution repeatedly applied onto the lavatory bowl surface during the method herein is formed by a composition comprising said surface modifying polymer. Said composition is subject to significant dilution upon application onto the lavatory bowl herein. Indeed, during the method of the present invention a composition comprising a surface modifying polymer may be diluted from 10.000× to 100.000×, preferably from 20.000× to 60.000×, more preferably 30.000× to 50.000× with water, preferably tap-water.

Accordingly, the composition may comprise up to 30%, preferably of from 1% to 25%, more preferably from 1% to 20%, and most preferably from 1% to 10%, by weight of said surface modifying polymer.

The solution herein may be formed by the combination of flush water with one composition or a multitude thereof. In the embodiment wherein a multitude of compositions are used, at least one of said compositions comprises said surface modifying polymer. It is envisaged that the surface modifying polymer herein may be present in one, more than one or even all of said multitude of compositions.

In a preferred embodiment herein, the composition forming the solution herein is thickened compositions. The thickened composition herein may be in the form of a gel or a pasteous composition.

If more than one compositions are present herein, said compositions may have different theologies and/or pH. Indeed, preferably one of said separate compositions is a liquid composition and the other composition(s) are liquid, gel or solid compositions more preferably the other composition(s) are liquid compositions.

The preferred thickened composition of the present invention has a viscosity of 2 cps or greater, more preferably of from 2 to 5000 cps, and still more preferably of from 100 to 3500 cps at 20° C. when measured with a Carri-Med Rheometer model $CSL^2$ 100® (Supplied by TA Instruments) with a 4 cm conic spindle in stainless steal (linear increment from 0.1 to 100 $sec^{-1}$ in max. 8 minutes).

It is at these preferred viscosities where the thickened composition herein show a good distribution of the composition over the surface to be cleaned as well as an adherence to said surface sufficient to stick to the surface during the cleaning operation itself.

The preferred liquid composition herein comprises water in an amount of from 0.01% to 90%, even more preferably of from 2% to 70% and most preferably 5% to 60% by weight of the total composition.

In another preferred embodiment, the liquid compositions herein are substantially free of water, preferably free of water. By "substantially free of water" it is meant that no water as such is added to the liquid composition(s). However, said liquid composition(s) may comprise traces of water added into the composition(s) through the raw-materials used to produce the liquid composition(s). The level of water added into the composition(s) through the raw-materials used to produce the liquid composition(s) is preferably below 10%, more preferably below 5%, even more preferably below 3% by weight of the total composition.

The pH of the liquid composition according to the present invention may typically be from 0 to 14. Preferably, the pH of the compositions herein, as is measured at 25° C., is at least, with increasing preference in the order given, 2, 3, 4, 5, or 5.9. Independently, the pH of the compositions herein, as is measured at 25° C., preferably is no more than, with increasing preference in the order given, 14, 13, 12, 11, 10, 9, 8, 7 or 6.1.

If more than one compositions are present in the system herein, said compositions may have different pHs.

Accordingly, the composition herein may further comprise an acid or base to adjust pH as appropriate.

Acidity, if present, may further contributes to formulate compositions according to the present invention that exhibit good limescale removing performance whilst exhibiting also good disinfecting properties. Accordingly, the compositions herein comprise organic and/or inorganic acids. A typical level of such an acid, when present, is of from 0.0001% to 15%, preferably from 0.001% to 10% and more preferably from 0.01% to 7% by weight of the total composition.

Suitable bases for use herein are the caustic alkalis, such as NaOH, KOH and/or LiOH, and/or the alkali metal oxides such, as Na- and/or K-oxide or mixtures thereof. Typical levels of such bases, when present, are of from 0.001% to 5% by weight, preferably from 0.01% to 3% and more preferably from 0.1% to 2% by weight of the composition.

Surface Modifying Polymer

The solution and accordingly the composition herein comprises a surface modifying polymer.

In a preferred embodiment according to the present invention, said surface modifying polymer provides the increased hydrophobicity for a prolonged period of times as described herein above to at least parts of the lavatory bowl surface. Preferably, any surface modifying polymer, providing the increased hydrophobicity to the cleaned surface for a prolonged period of times as described herein above (between 10 and 120 applications), can be used in the compositions according to the present invention.

Suitable surface modifying polymers for use herein are silicone glycol polymers. Depending on the relative position of the silicone-polyether chains, the silicone glycol polymer can be either linear or grafted.

Preferably, said silicone glycol polymer is according to the following formulae:

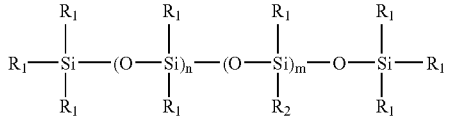

Grafted structure

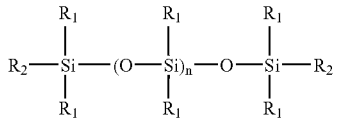

Linear structure wherein: each $R_1$ independently is H or a hydrocarbon radical; $R_2$ is a group bearing a polyether functional group; n is an integer of from 0 to 500; and for the grafted structure m is an integer of from 1 to 300, and preferably with n+m more than 1.

In a highly preferred embodiment herein the silicone polymer herein is a grafted silicone glycol.

Preferably, each $R_1$ independently is H or a hydrocarbon chain comprising from 1 to 16, more preferably a hydrocarbon chain comprising from 1 to 12 carbon atoms, and even more preferably $R_1$ is a $CH_3$-group. $R_1$ can also contain $NH_2$ groups and/or quaternary ammoniums.

Preferably, n is an integer of from 0 to 100, more preferably an integer of from 1 to 100, even more preferably n is an integer of from 1 to 50, and most preferably n is an integer of from 5 to 30.

Preferably, m (for the grafted structure) is an integer of from 1 to 80, more preferably m is an integer of from 1 to 30, and even more preferably m is an integer of from 2 to 10. Preferably, n+m is more than 2.

Preferably, $R_2$ is an alkoxylated hydrocarbon chain. More preferably, $R_2$ is according to the general formulae:

$$—R_3\text{-}(A)_p—R_4 \text{ or } \text{-}(A)_p—R_4$$

wherein: $R_3$ is a hydrocarbon chain; A is an alkoxy group or a mixture thereof; p is an integer of from 1 to 50; and $R_4$ is H or a hydrocarbon chain, or —COOH.

Preferably, $R_3$ is a hydrocarbon chain comprising from 1 to 12, more preferably 3 to 10, even more preferably from 3 to 6, and most preferably 3 carbon atoms.

Preferably, A is an ethoxy or propoxy or butoxy unit or a mixture thereof, more preferably A is an ethoxy group.

Preferably, p is an integer of from 1 to 50, more preferably p is an integer of from 1 to 30, and even more preferably p is an integer of from 5 to 20.

Preferably, $R_4$ is H or a hydrocarbon chain comprising from 1 to 12, more preferably 1 to 6, even more preferably from 3 to 6, and still even preferably 3 carbon atoms, most preferably $R_4$ is H.

Preferably, the silicone glycol polymers suitable herein have an average molecular weight of from 500 to 100,000, preferably from 600 to 50,000, more preferably from 1000 to 40,000, and most preferably from 2,000 to 20,000.

Suitable, silicone glycol polymers are commercially available from General electric, Dow Corning, and Witco under the following tradenames:

| GE Bayer Silicones: | Dow Corning: | Witco: |
|---|---|---|
| SF1488 ® | DC 8692 ® | L-77 ® |
| SF1288 ® | Q4-3667 ® | L-7001 ® |
| SF1388 ® | DC 5067 ® | L-7087 ® |
| SF1328 ® | DC 1248 ® | L-7200 ® |
| SF1528 ® | DC 3225C ® | L-7210 ® |
| SF1188 ® | DC 5225C ® | L-7220 ® |
| TP3799 ® | DC 190 ® | L-7230 ® |
| TP3800 ® | DC 5247 ® | L-7280 ® |
| TP3801 ® | FF 400 ® | L-7500 ® |
| TP3804 ® | DC 5329 ® | L-7510 ® |
| TP3805 ® | DC 5220 ® | L-7550 ® |
| TP3806 ® | DC 5097 ® | L7600 ® |
| TSF4440 ® | DC5604 ® | L-7602 ® |
| TSF4441 ® | DC 5197 ® | L-7604 ® |
| TSF4445 ® | DC 5103 ® | L-7605 ® |
| TSF4446 ® | DC 5093 ® | L-7607 ® |
| TSF4452 ® | DC 5237 ® | L-7608 ® |
| TSF4460 ® | DC 5098 ® | L-7622 ® |
| TSF4450 ® | DC 193 ® | L-7644 ® |
| AI3669 ® | DC 5200 ® | L-7650 ® |
| AI3465 ® | Sylgard 309 ® | L-7657 ® |
| AI3466 ® | DC 5211 ® | L-8500 ® |
| AI3467 ® | DC 5212 ® | L-8600 ® |
| AI3468 ® | | L-8610 ® |
| | | L-8620 ® |

In a highly preferred embodiment according to the present invention, the polymer herein is a Silicones-Polyethers copolymer, commercially available under the trade name SF 1288® from GE Bayer Silicones.

Polymers not providing the increased hydrophobicity to the lavatory bowl surface herein, cannot be used in the method according to the present invention. Examples, of polymers that when repeatedly applied (between at least 10 applications and up to 120 applications) as a solution comprising less than 30 ppm of polymer, provide no increase, not enough or too much increase in hydrophobicity of the lavatory bowl surface herein, are for example: Xanthan gum or other polysaccharides, polyvinyl pyridine N-oxide (PVNO), polyvinyl pyrrolidone (PVP), polyacrylates and/or fluoro-polymers Lavatory Bowl Cleaning System In a highly preferred embodiment of the present invention, the method for increasing the hydrophobicity of at least parts of a lavatory bowl surface comprising the steps of repeatedly applying to at least parts of said lavatory bowl surface a solution wherein said solution is applied using a lavatory bowl cleaning system preferably comprising: at least one liquid composition; and a dispenser, said dispenser comprising at least one container and a dispensing means connected to at least one of said container(s) for dispensing a single liquid composition or a combination of liquid compositions onto a lavatory bowl surface. Such a lavatory bowl cleaning system may be alternatively referred to herein as a liquid toilet rim-block. Preferably, said lavatory bowl cleaning system is a lavatory bowl rim-block.

Preferably, the lavatory cleaning system herein dispenses a single liquid composition or a combination of compositions from the rim portion of a lavatory bowl onto the lavatory bowl surface, wherein preferably the solution repeatedly applied to at least parts of said lavatory bowl surface is formed by a combination of lavatory bowl flush water and said single liquid composition or a combination of compositions.

The lavatory bowl cleaning system herein is preferably designed such that a sufficient amount of the liquid composition(s) herein is transferred to the lavatory bowl upon flushing of the lavatory bowl with water.

The Dispenser

The lavatory cleaning system of the present invention is preferably made of two main parts: a) at least one liquid composition; and b) a dispenser. Said dispenser of the lavatory cleaning system comprises at least one container and a dispensing means connected to at least one of said container(s) for dispensing a single liquid composition or a combination of liquid compositions onto a lavatory bowl surface. The at least one liquid composition is contained in the at least one container of the dispenser.

The container herein may by any suitable container to hold a liquid composition. Indeed, suitable containers herein include, but are not limited to bottles, jars, pouches, boxes, sachets and the like. Preferably, said container has at least one opening. The container is preferably made by blow molding of thermoplastic material, more preferably a material selected from group consisting of Polyethylene Terephthalate (PET), Polyethylene Terephthalate-G (PETG), Polyvinyl Chloride (PVC), Polypropylene (PP), Polystyrene (PS), High Impact Polystyrene (HIPS), Polyvinylidene Chloride (PVDC), and mixtures thereof.

In a preferred embodiment herein, the container herein is refillable and/or replaceable. Indeed, the container as a whole may be replaced once it is empty (replaceable) or the composition may be refilled into the existing container. The container may be refilled through an aperture in the container with the composition provided in a separate container, such as a bottle.

The dispensing means herein may by any suitable means to dispense at least one liquid composition onto a lavatory bowl surface. The lavatory bowl cleaning system may comprise one or a multitude of dispensing means. Suitable means to dispense at least one liquid composition onto a lavatory surface are apertures, spray heads, trays, pads with or without capillary channels, plates with or without capillary channels, blotter type dispensing means such as described in EP 775 741, and the like. The dispensing means herein comes into contact with water used to flush said lavatory bowl. Thereby the water used to flush said lavatory bowl mixes with at least one liquid composition of the lavatory bowl cleaning system herein and thereby delivers the composition(s) onto the lavatory bowl surface. The dispensing means herein may be connected to at least one of said container(s) by any suitable means, such as pipes, tubes, and the like, and may further contain valves, mixing chambers, shutters, and the like.

The dispenser as described above may comprise other elements such as: an attachment means; a supporting structure, holding the different elements of the dispenser together; blinds, used for aesthetics or to regulated water flow; wings, used to regulated water flow; etc. In a preferred embodiment herein, the lavatory bowl cleaning system, preferably said dispenser, additionally comprises an attachment means. Said attachment means is used to connect the lavatory bowl cleaning system, preferably the dispenser, to said lavatory bowl and hold it in place over its lifetime. Suitable attachment means are selected from the group consisting of: hooks, a suction cup or a set thereof, an adhesive, and mixtures thereof. Preferably said attachment means attaches the dispenser to the rim or suspends the dispenser from said rim. In a preferred embodiment said attachment means is a hook to suspend the dispenser from the rim of a lavatory bowl.

In a preferred embodiment herein, the dispenser herein comprises an attachment means and/or a supporting structure.

In a preferred embodiment of the present invention, wherein the lavatory bowl cleaning system comprises one container, the cleaning system comprises one liquid composition.

In another preferred embodiment herein, the lavatory bowl cleaning system comprises more than one container, preferably two to four, more preferable two to three, most preferably two containers.

Suitable dispensers for use in the lavatory bowl cleaning system as described herein are for example described in WO 01/44591, WO 99/66140, GB 2345494, WO 99/15375, WO 00/49238, GB 2358028, WO 95/38637, WO 01/77451, WO 00/42261, WO 01/06067, EP 538957, U.S. Pat. No. 6,230,334, EP 1046756 and WO 01/02653.

Optional Ingredients in the Compositions Herein

Chelant

The composition described herein and accordingly the solution applied onto the lavatory bowl surface during the method of the present invention may comprise a chelant as an optional ingredient.

Suitable and preferred chelants herein may be any of those known to those skilled in the art, preferably the ones selected from the group comprising phosphonate chelants, amino carboxylate chelants, other carboxylate chelants, polyfunctionally-substituted aromatic chelants, ethylenediamine N,N'-disuccinic acids, or mixtures thereof.

Preferred phosphonate chelants to be used herein may include ethane 1-hydroxy diphosphonates (HEDP) or salts thereof, alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelants to be used herein are diethylene triamine penta methylene phosphonate (DTPMP) and ethane 1-hydroxy diphosphonate (HEDP). Such phosphonate chelants are commercially available from Monsanto under the trade name DEQUEST®. Most preferably, the chelant herein is ethane 1-hydroxy diphosphonate (HEDP) or a salt thereof.

Polyfunctionally-substituted aromatic chelants may also be useful in the compositions herein. See U.S. Pat. No. 3,812,044, issued May 21, 1974, to Connor et al. Preferred chelants of this type in acid form are dihydroxydisulfobenzenes such as 1,2-dihydroxy -3,5-disulfobenzene.

A preferred biodegradable chelant for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein as chelants include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelants to be used herein include salicylic acid, aspartic acid, glutamic acid, glycine, malonic acid or mixtures thereof.

Another chelant for use herein is of the formula:

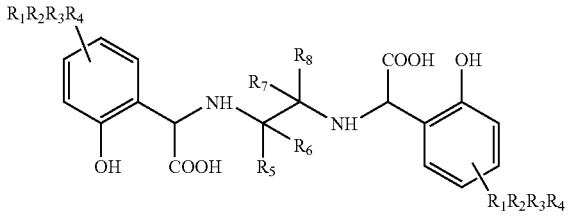

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Typically, single liquid composition or combination of liquid compositions dispensed onto said lavatory bowl surface according to the present invention may comprise up to about 5%, preferably from about 0.1% to about 3% by weight and more preferably from about 0.5%% to about 2% by weight of the total composition of a chelant.

Nonionic Surfactants

The composition described herein and accordingly the solution applied onto the lavatory bowl surface during the method of the present invention may comprise, as an optional ingredient but highly preferred ingredient a nonionic surfactant, or mixtures thereof.

Accordingly, the composition herein may comprise up to 70%, preferably of from 1% to 30%, more preferably of from 1% to 20%, and most preferably of from 1% to 10% by weight of the total composition of a nonionic surfactant or mixtures thereof.

The presence of nonionic surfactants in the composition(s) herein may allow to provide compositions with further improved shine benefit. Indeed, it has been found that the presence of a nonionic surfactant further contributes to the reduction or even prevention of mineral deposits as described herein above.

Preferred nonionic surfactants for use herein are alkoxylated alcohols according to the formula $RO(E)_e(P)_pH$ where R is a hydrocarbon chain of from 2 to 24 carbon atoms, E is ethylene oxide and P is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from Shell under the trade name Lutensol®.

Other Surfactants

The composition described herein and accordingly the solution applied onto the lavatory bowl surface during the method of the present invention may further comprise a surfactant other than the nonionic surfactant, if any, as described above. All types of surfactants may be used in the present invention including anionic, cationic, amphoteric or zwitterionic surfactants. It is also possible to use mixtures of such surfactants without departing from the spirit of the present invention.

The presence of surfactants other than the nonionic surfactants in the composition(s) of the present invention allows to provide good cleaning performance.

The composition herein may comprise up to 70%, preferably of from 0.1% to 60%, more preferably of from 1% to 50% and most preferably of from 5% to 40% by weight of the total composition of a surfactant or mixtures there.

Suitable amphoteric surfactants to be used in the compositions according to the present invention include amine oxides. Preferred long chain amine oxides for use herein are for instance natural blend $C_8$-$C_{10}$ amine oxides as well as $C_{12}$-$C_{16}$ amine oxides commercially available from Hoechst. Preferred short chain amine oxides for use herein are for instance natural blend $C_8$-$C_{10}$ amine oxides available from Hoechst.

In a highly preferred embodiment according to the present invention, the composition according to the present invention may further comprise an alkyl alkoxylated sulphate surfactant. Suitable alkyl alkoxylated sulphate surfactants for use herein are according to the formula $RO(A)_mSO_3M$ wherein: R is a substituted or unsubstituted, linear or branched $C_6$-$C_{24}$, preferably a $C_8$-$C_{20}$, more preferably a $C_{12}$-$C_{20}$, even more preferably a $C_{12}$-$C_{18}$, and most preferably a $C_{12}$-$C_{14}$ alkyl group; A is an ethoxy or propoxy or butoxy unit; m is greater than zero, preferably at least 0.1, more preferably between 0.1 and 15, even more preferably between 0.5 and 6, and most preferably between 0.5 and 4; and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates and alkyl butoxylated sulfates are contemplated herein. Highly preferred herein as alkyl alkoxylated sulphate surfactants are alkyl ethoxylated sulfates, i.e., A is an ethoxy group. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine isopropanolamine, mixtures thereof, and the like. Exemplary surfactants are $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), $C_{12}$-$C_{14}$ alkyl polyethoxylate (3.0) sulfate ($C_{12}$-$C_{14}$E(3.0)SM) and $C_{12}$-$C_{18}$ alkyl polyethoxylate (4.0) sulfate ($C_{12}$-$C_{18}$E(4.0)SM), wherein M is conveniently selected from sodium and potassium. Of particular importance herein is an alkyl ethoxylated sulfate with a degree of ethoxylation of 2.4 or between 2-3. Sodium $C_{12}/C_{14}$ E3 sulphate may be for example commercially available from Albright & Wilson under the name EMPICOL ESC3®.

When present, alkyl alkoxylated sulphate surfactants contribute to product viscosity.

Solvent

The composition described herein and accordingly the solution applied onto the lavatory bowl surface during the method of the present invention may further comprise a solvent.

Accordingly, the single liquid composition or combination of liquid compositions dispensed onto said lavatory bowl surface according to the present invention may comprise up to 30%, preferably of from 0.1% to 30%, more preferably of from 1% to 20%, and most preferably of from 1% to 15% by weight of the total composition of a solvent, or mixtures there.

Suitable solvents for use herein include ethers and diethers having from 4 to 14 carbon atoms, preferably from 6 to 12 carbon atoms, and more preferably from 8 to 10 carbon atoms, glycols or alkoxylated glycols, glycol ethers and/or derivatives, polyols, alkoxylated aromatic alcohols, aromatic alcohols, aliphatic branched or linear alcohols, alkoxylated aliphatic branched or linear alcohols, terpenes, and mixtures thereof. Other suitable solvents include ter amilic alcohol, terpene solvents and the like.

Thickening System

The composition described herein and accordingly the solution applied onto the lavatory bowl surface during the method of the present invention may comprise a thickener or a thickening system as a highly preferred optional ingredient.

Suitable thickeners herein are selected from the group consisting of organic thickeners, and inorganic thickeners and mixtures thereof.

Preferably the thickener herein when present, is an organic thickeners, more preferably a polyacrylate; a gum, which can be derived from marine sources (agar, alginates, carrageenan, furcellaran), terrestrial plants (guar gum, gum Arabic, gum tragacenth, karaya gum, locust bean gum and pectin), animal sources (gelatin), microbial polysaccharides (dextran, gellan gum, rhamsam gum, welan gum, Xanthan gum); a polysaccharide derivative (carboxymethylcellulose, methylhydroxypropyl cellulose, hydroxy propyl cellulose, hydroxyethyl cellulose, propylene glycol alginate, hydroxy propyl guar and modified starters); or a mixture thereof.

Other Suitable thickening systems are selected from the group consisting of a cationic/anionic surfactant system self-thickening systems.

Preferably, the compositions herein comprise a polyacrylate or a gum or a combination thereof.

The compositions according to the present invention may comprise from 0.005% to 15%, preferably from 0.01% to 10%, more preferably from 0.02% to 5% by weight of the total composition of a thickener or a thickening system.

Perfumes

The composition described herein and accordingly the solution applied onto the lavatory bowl surface during the method of the present invention may comprise, as an optional ingredient a perfume ingredient. The compositions according to the present invention may comprise from 0.01% to 40%, preferably from 0.01% to 35%, more preferably from 0.1% to 30%, and most preferably from 0.1% to 25% by weight of the total composition of said perfume ingredient.

Depending on the end use envisioned, the compositions according to the present invention may further comprise a variety of other ingredients including dyes, optical brighteners, builders, pigments, solvents, buffering agents, radical scavengers, polymers, stabilizers and the like.

Experimental Data

Table 1 shows the contact angle data generated over 120 applications of tap-water or diluted solutions (3 ppm) of different polymers, such as polyvinyl pyridine N-oxide (PVNO), polyvinyl pyrrolidone (PVP), and silicone glycol polymer (SF1288® commercially available from GE Bayer Silicones.) or diluted solution (9 ppm) of fluoro-polymer (Flurolink F10/A® commercially available from Ausimont). With a level of 3 ppm fluoro-polymer F10/A® no surface modification was observed. The experimental data was collected by measuring the contact angle between water and standard black glossy (SENIO®) using the static contact angle measurement method as described herein above, after repeated application to the tiles for 12 sec. of the tap-water or the diluted solutions.

TABLE 1

| | Static contact angles between deionized water and black glossy tiles | | | | |
|---|---|---|---|---|---|
| Number of applications | Tap-water | SF 1288 ® | PVP | PVNO | F10/A ® |
| 0 | 4.925 | 4.925 | 4.925 | 4.925 | 4.925 |
| 2 | 13 | n/a | n/a | n/a | 66.875 |
| 10 | 19.333 | 27.2 | 23.25 | 9.575 | 68 |
| 20 | 24.53 | 33.73 | 31.69 | 16.37 | 70 |
| 30 | 23.81 | 41.825 | 32.55 | 26.7 | n/a |
| 60 | 24 | 45.31 | 32.96 | 34.01 | n/a |
| 120 | 31.84 | 51.72 | 38.2 | n/a | n/a |

The plot on FIG. 1 is the graphical representation of the above data.

EXAMPLES

The following examples will further illustrate the present invention. The compositions are made by combining the listed ingredients in the listed proportions. The following Examples are meant to exemplify compositions according to the present invention but are not necessarily used to limit or otherwise define the scope of the present invention.

The compositions may be present in the container of a lavatory bowl cleaning system comprising as described herein above.

I)

| Ingredients | Weight % |
|---|---|
| Kelzan T ® | 0.5 |
| Dobanol 91.8 ® | 15 |
| HLAS | 1 |
| Na HEDP | 0.5 |
| SF1288 ® | 5.0 |
| Perfume | 12 |
| Water & minors | balance |

pH of 6 adjusted with $NaOH/H_2SO_4$

II)

| Ingredients | Weight % |
|---|---|
| Acusol 800S ® | 3 |
| Steol CS-330 ® | 20 |
| NaOH | 0.5 |
| DTPMP | 2 |
| DC193 ® | 10 |
| Perfume | 8 |
| Water & minors | balance |

III)

| Ingredients | Weight % |
|---|---|
| Natrosol HHR ® | 0.5 |
| Dobanol 91.8 ® | 1 |
| Daclor 70-3-23 ® | 15 |
| DTPA | 1.5 |
| DC 5220 ® | 7 |
| Perfume | 10 |
| Water & minors | balance |

IV)

| Ingredients | Weight % |
|---|---|
| Kelzan T ® | 0.6 |
| Dobanol 91.8 | 20 |
| Silicone SF1188 ® | 7 |
| Na2 HEDP | 2 |
| Water & minors | balance |

V)

| Ingredients | Weight % |
|---|---|
| Natrosol HHR ® | 0.45 |
| Trilon FS ® | 1.3 |
| Silicone SF1288 ® | 7.0 |
| Marlinat 242/90 ® | 10 |
| Nansa LSS 38/AS ® | 1 |
| Perfume | 5 |
| Water & minors | balance |

VI)

| Ingredients | Weight % |
|---|---|
| SF1288 ® | 10 |
| Water & minors | balance |

Dobanol® 23-3 is a $C_{12}$-$C_{13}$ EO3 nonionic surfactant, Dobanol® 45-7 is a $C_{14}$-$C_{15}$ EO7 nonionic surfactant, Dobanol® 91-8 is a $C_9$-$C_{11}$ EO8 nonionic surfactant commercially and Dobanol® 91-10 is a $C_9$-$C_{11}$ EO10 nonionic surfactant all commercially available from SHELL.

Na HEDP is Sodium ethane 1-hydroxy diphosphonate.

DTPMP is diethylene triamine penta methylene phosphonate.

DTPA is diethylene triamine pentaacetate.

ssEDDS is ethylenediamine N,N'-disuccinic acid.

SF1288® and SF1188® are Silicones-Polyethers copolymers, commercially available from GE Bayer Silicones.

Kelzan T® is Xanthan Gum commercially available from CP-Kelco.

HLAS is a linear alkylbenzene sulphonic acid anionic surfactant.

DC 5220® and DC193® are silicone glycol polymers commercially available from Dow Corning.

Acusol 800® is a polyacrylate commercially available from Rohm & Haas.

Natrosol HHR® is a Hydroxycellulose commercially available from Hercules.

Daclor 70-3-23® is a branched alkyl ethoxylated sulfate and Marlinat 242/90® is an alkyl ethoxylated sulfate, both commercially available from Sasol.

Steol CS-330® is an alkyl ethoxylated sulfate commercially available from Stepan.

Trilon FS® is a amino carboxylate commercially available from BASF

Nansa LSS 38/AS® is an alpha-olefin sulfonate and EMPICOL LX 28® is an alkyl sulfate, both commercially available from Huntsman.

What is claimed is:

1. A method for increasing the hydrophobicity of at least parts of a lavatory bowl surface comprising the steps of repeatedly applying to at least parts of said lavatory bowl surface a solution comprising a surface modifying polymer, the surface modifying polymer being included in an amount of less than 30 ppm, to provide a contact angle between water and at least parts of said surface after at least 10 applications and up to 120 applications that is at least 5° higher as compared to the contact angle of said surface treated with water alone and does not exceed a contact angle of 55° and wherein said solution additionally comprises a chelant selected from the group consisting of phosphonate chelants, amino carboxylate chelants, other carboxylate chelants, polyfunctionally-substituted aromatic chelants, ethylenediamine N,N'-disuccinic acids, and mixtures thereof, and wherein said surface modifying polymer is a silicone polymer.

2. The method according to claim 1, wherein said contact angle between water and at least parts of said surface is from about 5° to about 18° higher as compared to the contact angle of said surface treated with water alone.

3. The method according to claim 1, wherein said contact angle between water and at least parts of said surface does not exceed a contact angle of about 52°.

4. The method according to claim 1, wherein said solution comprises from about 0.1 ppm to about 25 ppm by weight of the total solution of said surface modifying polymer.

5. The method according to claim 1, wherein said surface modifying polymer is a silicone glycol polymer.

6. The method according to claim 1, wherein said surface modifying polymer is a linear or grafted silicone glycol polymer according to the following formulae:

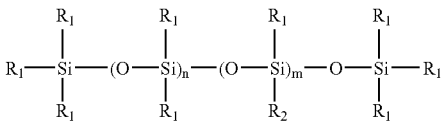

Grafted structure

-continued

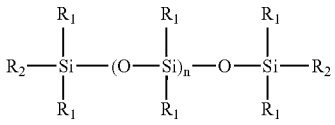

Linear structure wherein each $R_1$ independently is a hydrocarbon radical; $R_2$ is a group bearing a polyether functional group; n is an integer of from 0 to about 500; and for the grafted structure m is an integer of from about 1 to about 300, and with n+m more than about 1.

7. The method according to claim 1, wherein said chelant is a phosphonate chelant or a mixture thereof, selected from the group consisting of ethane 1-hydroxy diphosphonates (HEDP) or salts thereof, alkylene poly (alkylene phosphonate), amino phosphonate compounds, including amino aminotri(methylene phosphonic acid)(ATMP), nitrilo trimethylene phosphonates (NTP), ethylene diamine tetra methylene phosphonates, and diethylene triamine penta methylene phosphonates (DTPMP) and mixtures thereof.

8. The method according to claim 1, wherein said chelant is ethane 1-hydroxy diphosphonate (HEDP) or a salt thereof.

9. The method according to claim 1, wherein said solution additionally comprises a nonionic surfactant or mixtures thereof.

10. The method according to claim 1, wherein said solution is applied onto said lavatory bowl surface by means of a lavatory bowl cleaning system.

11. The method according to claim 10, wherein said lavatory bowl cleaning system comprises: at least one liquid composition; and a dispenser, said dispenser comprising at least one container and a dispensing means connected to said at least one container for dispensing said liquid composition onto a lavatory bowl surface; wherein said liquid composition dispensed onto said lavatory bowl surface comprises said surface modifying polymer.

12. The method according to claim 11, wherein said single liquid composition or said combination of liquid compositions comprises a chelant.

13. The method according to claim 12, wherein said chelant is a phosphonate chelant or a mixture thereof, selected from the group consisting of ethane 1-hydroxy diphosphonates (HEDP) or salts thereof, alkylene poly (alkylene phosphonate), amino phosphonate compounds, including amino aminotri(methylene phosphonic acid) (ATMP), nitrilo trimethylene phosphonates (NTP), ethylene diamine tetra methylene phosphonates, and diethylene triamine penta methylene phosphonates (DTPMP) and mixtures thereof.

14. The method according to claim 12, wherein said chelant is ethane 1-hydroxy diphosphonate (HEDP) or a salt thereof.

15. The method according to claim 12, wherein said single liquid composition or said combination of liquid compositions dispensed onto said lavatory bowl surface comprise up to 5% by weight of the total composition of said chelant.

16. The method according to claim 11, wherein said dispenser additionally comprises an attachment means.

17. The method according to claim 16, wherein said attachment means attaches said dispenser to die rim of a lavatory bowl or suspends said dispenser from said rim.

18. The method according to claim 11, wherein said single liquid composition or said combination of liquid compositions dispensed onto said lavatory bowl surface additionally comprise a nonionic surfactant or mixtures thereof.

19. The method according to claim 11, wherein said single liquid composition or said combination of liquid compositions dispensed onto said lavatory bowl surface comprise up to about 50% by weight of the total composition of said nonionic surfactant or mixtures thereof.

20. A method for increasing the hydrophobicity of at least parts of a lavatory bowl surface comprising the steps of A) providing a lavatory bowl cleaning system comprising at least one liquid composition; and a dispenser, said dispenser comprising at least one container and a dispensing means connected to at least one of said container(s) for dispensing said liquid composition onto a lavatory bowl surface; wherein said liquid composition dispensed onto said lavatory bowl surface comprises up to about 30 % of a surface modifying polymer, and B) repeatedly applying to at least parts of said lavatory bowl surface a solution comprising a surface modifying polymer, the surface modifying polymer being included in an amount of less than 30 ppm, to provide a contact angle between water and at least parts of said surface after at least 10 applications and up to 120 applications that is at least 5° higher as compared to the contact angle of said surface treated with water alone and does not exceed a contact angle of 55° and wherein said solution additionally comprises a chelant selected from the group consisting of phosphonate chelants, amino carboxylate chelants, other carboxylate chelants, polyfunctionally-substituted aromatic chelants, ethylenediamine N,N'-disuccinic acids, and mixtures thereof, and wherein said surface modifying polymer is a silicone polymer.

* * * * *